US009393820B2

(12) United States Patent
Kobayashi et al.

(10) Patent No.: US 9,393,820 B2
(45) Date of Patent: Jul. 19, 2016

(54) LIQUID EJECTING HEAD AND LIQUID EJECTING APPARATUS

(71) Applicant: Seiko Epson Corporation, Tokyo (JP)

(72) Inventors: Haruki Kobayashi, Shiojiri (JP); Yoshiyuki Okazawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/800,058

(22) Filed: Jul. 15, 2015

(65) Prior Publication Data

US 2016/0016422 A1 Jan. 21, 2016

(30) Foreign Application Priority Data

Jul. 17, 2014 (JP) ..... 2014-146542

(51) Int. Cl.
*B41J 2/175* (2006.01)
*B41J 19/00* (2006.01)

(52) U.S. Cl.
CPC ..... *B41J 19/005* (2013.01); *B41J 2/1753* (2013.01); *B41J 2/17526* (2013.01)

(58) Field of Classification Search
CPC ..... B41J 2/17526; B41J 2/1753
USPC ..... 347/20, 37
See application file for complete search history.

(56) References Cited

U.S. PATENT DOCUMENTS 5,627,577 A * 5/1997 Buican ..... B41J 25/34 347/50
2008/0007580 A1* 1/2008 Shinada ..... B41J 2/1753 347/7
2012/0247816 A1* 10/2012 Koide ..... B41J 2/14233 174/254

FOREIGN PATENT DOCUMENTS

JP 2003-211700 A 7/2003
JP 2014-030981 A 2/2014

* cited by examiner

*Primary Examiner* — Jason Uhlenhake
(74) *Attorney, Agent, or Firm* — Harness, Dickey & Pierce, P.L.C.

(57) ABSTRACT

A liquid ejecting head including a head which discharges ink from a nozzle surface on which a nozzle is included based on data, a signal line which sends data to the head via a connector, a carriage on which the head is mounted, and a first concave section and second concave section which accommodate the signal line and are included toward the outside of the carriage, in which the signal line is connected to the connector lined up with a terminal in the Y direction, and a position of a folded portion of the signal line which is accommodated in the first concave section and the second concave section overlaps with a fourth portion to a fifth portion which are a section of the carriage, and overlaps with a first portion to a second portion which are a section of the head in the X direction.

15 Claims, 11 Drawing Sheets

LIQUID EJECTING HEAD AND LIQUID EJECTING APPARATUS

CROSS-REFERENCE TO RELATED APPLICATIONS

This application claims priority to Japanese Patent Application No. 2014-146542 filed on Jul. 17, 2014. The entire disclosure of Japanese Patent Application No. 2014-146542 is hereby incorporated herein by reference.

BACKGROUND

1. Technical Field

The present invention relates to a liquid ejecting head and a liquid ejecting apparatus, and in particular relates to an ink jet recording head and an ink jet recording apparatus which eject ink as the liquid.

2. Related Art

An ink jet recording head which ejects ink droplets is given as a representative example of a liquid ejecting head which discharges liquid. As this ink jet recording head, for example, an apparatus has been proposed in which a signal line such as a flexible cable is connected to a circuit board, and which is provided with a head which ejects ink droplets based on recording data which is sent from the signal line to the circuit board, and a carriage which holds the head (for example, refer to JP-A-2014-030981).

Meanwhile, resolution of ink jet recording apparatuses has improved and the amount of recording data which is sent to the recording head in one go has increased in recent years. Accompanying the increase in recording data, the width of the signal line is widened or a plurality of signal lines are used. In addition, there are times when the signal line is folded due to a cause such as the configuration of the ink jet recording head or the scanning direction. Accordingly, when the signal line with a width that is widened or the plurality of signal lines are folded, a region which is occupied by the folded portion tends to increase.

For example, in an ink jet recording head according to JP-A-2014-030981, a signal line which is connected to a connection section of a circuit board is arranged along the inside of a carriage at the outer periphery of the head, but is folded in the vicinity of a side surface of the head. In the portion where the signal line is folded in this manner, the thickness increases and the size of the head increases.

Here, such a problem does not only exist in an ink jet recording head that discharges ink, but also exists in a liquid ejecting head and a liquid ejecting apparatus which eject liquid other than ink.

SUMMARY

An advantage of some aspects of the invention is to provide a liquid ejecting head and a liquid ejecting apparatus in which it is possible to suppress a size increase.

Aspect 1

According to this aspect, there is provided a liquid ejecting head including a head configured to discharge liquid from a nozzle on a nozzle surface based on data, a signal line configured to send head data via a connector of the head, a carriage on which the head is mounted, and a concave section which accommodates the signal line and is open toward the outside of the carriage, in which in a case where X direction, Y direction, and Z direction are orthogonal to one another, and the carriage is configured to move relative to a discharge medium in the X direction and the nozzle surface is specified as the XY horizontal plane, the signal line is connected to the connector with terminals lined up in the Y direction, and a position of a portion of the signal line which is accommodated in the concave section overlaps with a position of a portion of at least the carriage in the X direction, and overlaps with a portion of at least the head in the X direction.

In this aspect, a portion of the signal line is arranged which overlaps with a portion of the carriage and the head in the X direction. That is, it is possible to avoid an increase in size in the width which the portion of the signal line occupies in the X direction and realize a size reduction of the liquid ejecting head. In addition, the portion of the signal line overlaps not only with the carriage, but also the head in the X direction. That is, since the concave section which accommodates the portion of the signal line overlaps with the head in the X direction, the carriage may be formed so as to match the width of the head in the X direction, and it is possible to reduce the size in the width of the concave section. Thereby, it is possible to further reduce the size of the liquid ejecting head in the X direction. Furthermore, the connector which is connected to the signal line is lined up in the Y direction. Thereby, it is possible to provide a liquid ejecting head further reduced in size in the X direction than in a case where the connector which is lined up in the X direction is adopted. In addition, since the signal line is accommodated in the concave section, it is possible to suppress exposure of the signal line and suppress liquid from unintentionally adhering to the signal line.

Aspect 2

It is preferable that the liquid ejecting head according to Aspect 1 further includes a fixing member which fixes the head to the carriage, in which the position in the X direction of the concave section which accommodates the signal line and the position in the X direction of the fixing member overlap with one another. Thereby, it is possible to arrange the fixing member further to the outside in the X direction, and it is possible to easily positionally align the head and the carriage. In addition, since it is possible to arrange the concave section further to the inside than the head, it is possible to reduce the size of the head in the X direction.

Aspect 3

In the liquid ejecting head according to Aspect 2, it is preferable that the head has a head body which has a driving element, a nozzle, a pressure chamber, and a manifold, a rigid substrate which has the connector and is electrically connected to the head body, and a supply source fixing member for mounting a liquid supply source, the supply source fixing member having a flow path which supplies liquid from the liquid supply source to the head body, in which the rigid substrate is fixed between the head body and the supply source fixing member, and the fixing member fixes the supply source fixing member to the carriage at a position which does not pass through the rigid substrate. Thereby, it is possible to reduce the size of the liquid ejecting head in the Z direction.

Aspect 4

In the liquid ejecting head according to Aspect 3, it is preferable for a gap between the supply source fixing member and the carriage to be narrower than the length of the fixing member in the Z direction. Thereby, it is possible to further reduce the size of the liquid ejecting head in the Z direction.

Aspect 5

In the liquid ejecting head according to Aspect 3 and Aspect 4, it is preferable for a gap between the outermost fixing members in the X direction to be 0.8 to 1.1 with respect to the dimension of the rigid substrate. Thereby, since it is possible to secure a sufficient dimension of the rigid substrate, it is possible to avoid mounting a wiring pattern on the rigid substrate becoming difficult even if the number of terminals which are mounted on the rigid substrate are large.

Aspect 6

In the liquid ejecting head according to Aspect 3 to Aspect 5, it is preferable for the connector to be arranged only on one side in the X direction on the rigid substrate. Thereby, it is possible to further reduce the size of the rigid substrate of the invention in the X direction than a rigid substrate which is provided with a plurality of connectors on both sides in the X direction.

Aspect 7

According to this aspect of the invention, there is provided a liquid ejecting apparatus including the liquid ejecting head which is described in Aspect 1 to Aspect 7.

In this aspect, a liquid ejecting apparatus is provided with reduced size in the X direction.

Aspect 8

It is preferable that the liquid ejecting apparatus according to Aspect 7 includes a cap with respect to the head, the cap being arranged further to the other side in the X direction than a rib, and a fixed section which is fixed to the signal line more to the one side in the X direction than the cap, in which the connector and a region where an ejection medium of a maximum printable size is transported overlap in the Z direction at a position where the head is capped. Otherwise it is preferable that the liquid ejecting apparatus according to Aspect 7 includes a cap with respect to the head, and wherein the connector where the head is in confrontation with the cap is configured to overlap an ejection medium in the Z direction. Thereby, it is possible to further reduce the size of the width of the liquid ejecting apparatus in the X direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
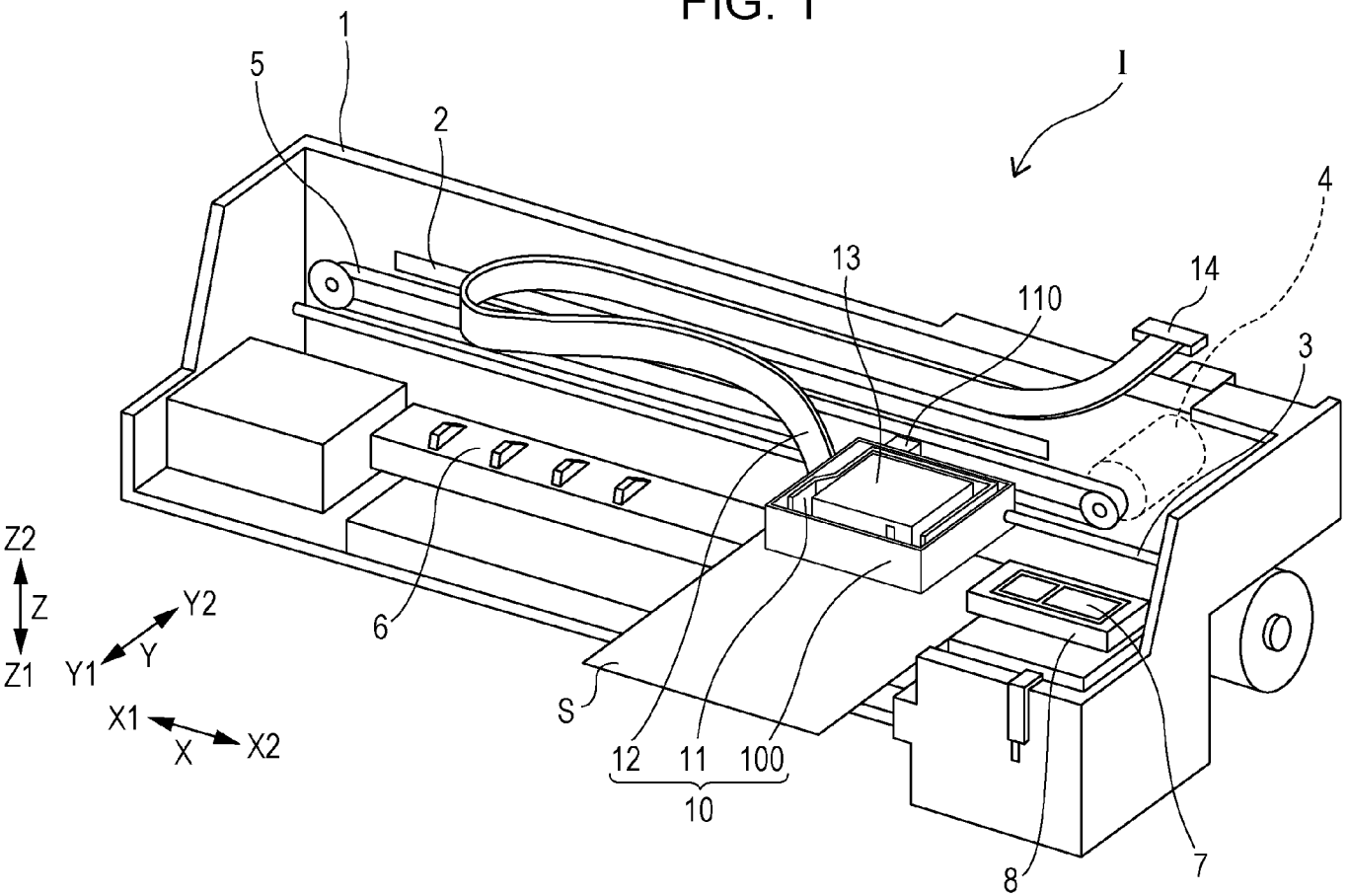
FIG. 1 is a schematic perspective diagram of an ink jet recording apparatus.

FIG. 1 is a schematic perspective diagram of an ink jet recording apparatus which is provided with an ink jet recording head according to Embodiment 1. Here, the ink jet recording head is an example of a liquid ejecting head and the ink jet recording apparatus is an example of a liquid ejecting apparatus.

An ink jet recording apparatus I includes an ink jet recording head 10. Although described later in detail, the ink jet recording head 10 includes a head 11 which discharges ink droplets based on data, a signal line 12 through which data is sent to the head 11, and a carriage 100 on which the head 11 is mounted. In addition, in the present embodiment, an ink cartridge 13 which is a liquid supply source in which ink of different colors of inks of cyan (C), magenta (M), yellow (Y), and black (K) are retained is fixed to the head 11 so as to able to be attached and detached. Here, the ink cartridge 13 retains ink of the four colors in one casing such that each color is respectively supplied from each of four discharge openings 17. In addition, a sensor which detects a remaining amount of ink is mounted in the ink cartridge 13 and it is possible to output information on the remaining amount of ink in relation to the remaining amount of ink using the sensor from a first terminal section 115 (refer to FIG. 3).

Furthermore, the ink jet recording apparatus I includes an apparatus main body 1 and a carriage shaft 3 which is attached to the apparatus main body 1. The carriage shaft 3 extends in one direction and both ends thereof are attached to the apparatus main body 1. The carriage 100 of the ink jet recording head 10 is able to move along the carriage shaft 3.

A driving motor 4 is attached to the apparatus main body 1 such that driving force from the driving motor 4 reaches the carriage 100 via a plurality of gears which are not shown in the drawings and a timing belt 5. The carriage 100 moves along the carriage shaft 3 due to the driving force from the driving motor 4. Meanwhile, a platen 6 is included in the apparatus main body 1 along the carriage shaft 3 such that a recording medium S such as paper which is fed by a paper feeding device, which is not shown in the drawings, is transported on the platen 6.

A carriage device 8 is included, at an end section of the carriage shaft 3 of the carriage 100, which has a cap 7 that seals a nozzle surface on which a nozzle is included that discharges ink of the ink jet recording head 10. Drying of ink is prevented by sealing the nozzle surface using the cap 7. In addition, the cap 7 also functions as an ink receptacle during a flushing operation. The position in a state where the nozzle surface of the ink jet head is sealed by the cap 7 in this manner is referred to as a home position.

Here, the X direction, Y direction, and Z direction are defined as being orthogonal to one another. The X direction is a direction where the ink jet recording head 10 moves relative to the recording medium S. In the present embodiment, the X direction is a movement direction along the carriage shaft 3. In the X direction, a side close to the home position is referred to as an X2 side, and a side far from the home position is referred to as an X1 side.

The Y direction is a direction which is orthogonal to the X direction, and is a direction such that the XY horizontal plane which is specified by the X direction and the Y direction becomes the nozzle surface. The nozzle surface will be described later. In the present embodiment, the Y direction may also be a direction in which the recording medium S is transported, and the upstream side is referred to as a Y2 side and the downstream side is referred to as a Y1 side where the recording medium S is transported.

The Z direction is a direction which is orthogonal to the X direction and the Y direction. A side toward which ink is discharged from the nozzle surface is referred to as a Z1 side, and the opposite side thereto is referred to as a Z2 side.

A linear scale 2 is arranged parallel to the carriage shaft 3 along the X direction on an inner surface of the apparatus main body 1. The linear scale 2 is a belt-shaped member which is produced using a transparent resin film, and is for example printed using a plurality of non-transparent stripes which cut across the belt width direction on a surface of a transparent base film. Each belt stripe is formed with the same width at a constant pitch in the X direction. In addition, a linear encoder 110 for optically reading a stripe of the linear scale 2 is included on the rear surface (the surface on the Y2 side in the Y direction) of the carriage 100. The linear encoder 110 outputs an encoder pulse according to the position of the carriage 100 as position information in the X direction.

Although not particularly illustrated, a control section is included in the apparatus main body 1. The control section controls an operation of ink jet recording apparatus I and the ink jet recording head 10.

The control section is connected to the ink jet recording head 10 via the signal line 12, and is able to discharge ink by sending data to the ink jet recording head 10.

In addition, although not particularly illustrated, the control section is connected to the linear encoder 110 by a wiring such as an FFC, and positional information is sent to the control section from the linear encoder 110. Furthermore, a second terminal section 116 (refer to FIG. 9) which electrically contacts the first terminal section 115 of the ink cartridge 13 and which is able to receive information on the remaining amount of ink is included in the carriage 100. The second terminal section 116 is connected to the control section by a wiring such as the FFC, and information on the remaining amount of ink is sent to the control section.

Such a control section transports the recording medium S to the paper feeding device or the like in the Y direction based on data which indicates a pattern of ink droplets which are ejected on the recording medium S, and transports the ink jet recording head 10 in the X direction by driving the driving motor 4 while the position of the carriage 100 is recognized based on an encoder panel. Then, the control section ejects ink by sending the data to the ink jet recording head 10 via the signal line 12.

Figure 2:
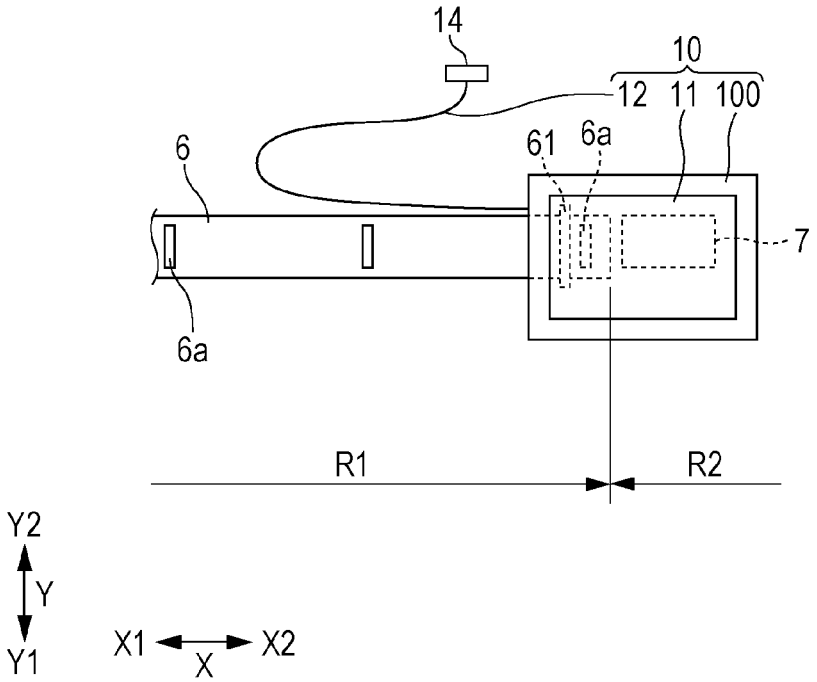
FIG. 2 is a planar diagram illustrating a main section of the ink jet recording apparatus.

FIG. 2 is a planar diagram illustrating a main section of the ink jet recording apparatus where the ink jet recording head is positioned at the home position.

A plurality of ribs 6*a* which support the recording medium S on the upper surface at the Z2 side are included on the platen 6. The cap described above is arranged further to the X2 side than the ribs 6*a* ("further to the other side than the ribs in the X direction" in the claims). In addition, a fixing section 14 which fixes the signal line 12 is arranged further to the X1 side than the cap 7 in the X direction ("further to the one side than the cap in the X direction" in the claims).

A region which is occupied by the recording medium S of a maximum printable size which is transported along the Y direction while being supported on the ribs 6*a* is a transport region R1. Then, out of regions in which it is possible for the ink jet recording head 10 to move in the X direction, a region which excludes the ink jet recording head R1 is the non-transport region R2.

The cap 7 described above is positioned in the non-transport region R2. Accordingly, although the greater portion of the ink jet recording head 10 which is positioned at the home position is positioned in the non-transport region R2, a connector 61 that is connected by the signal line 12 which is included in the ink jet recording head 10 overlaps with the transport region R1 in the Z direction.

In this manner, at least the connector 61 overlaps with the transport region R1 in the Z direction at a position where the nozzle surface of the ink jet recording head 10 is sealed by the cap 7. That is, compared to a case where the entirety of the ink jet recording head 10 is positioned in the non-transport region R2, it is possible to arrange the part of the ink jet recording head 10 that is overlapped by the connector 61 in the X direction near to the X1 side. Accordingly, it is possible reduce the size of the width of the ink jet recording apparatus I in the X direction.

Figure 3:
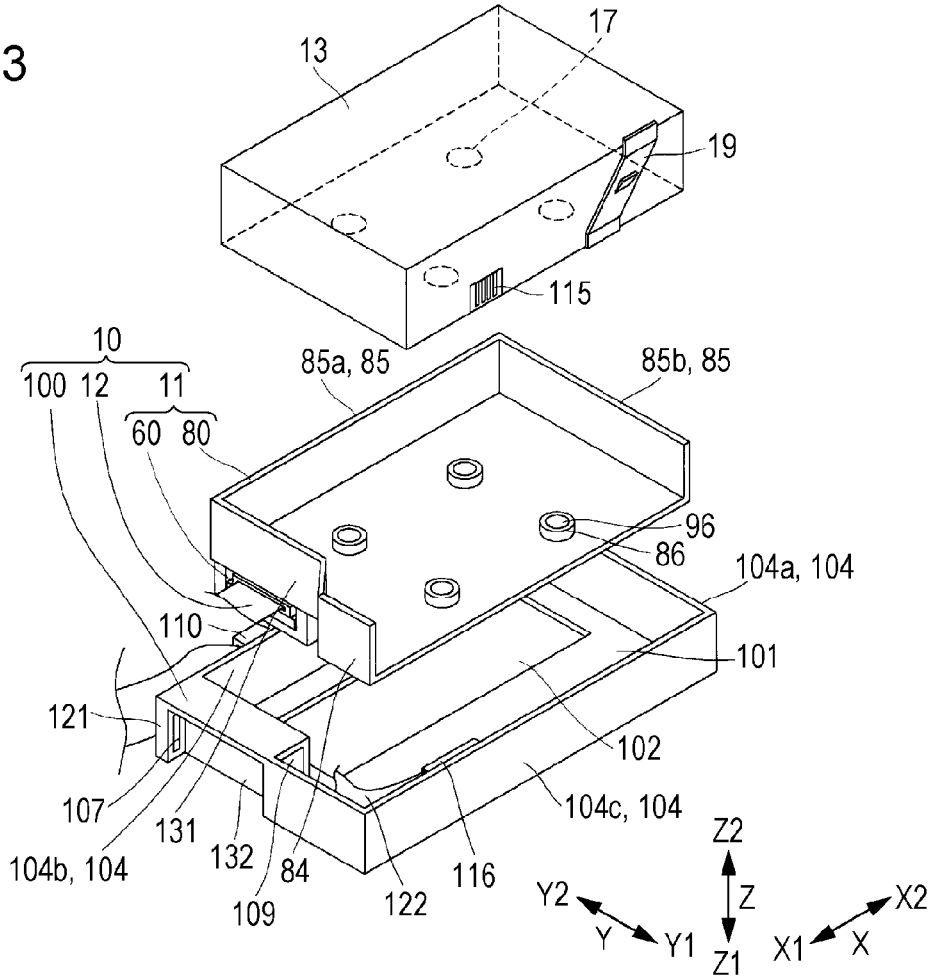
FIG. 3 is an exploded perspective diagram of an ink jet recording head.
Figure 4:
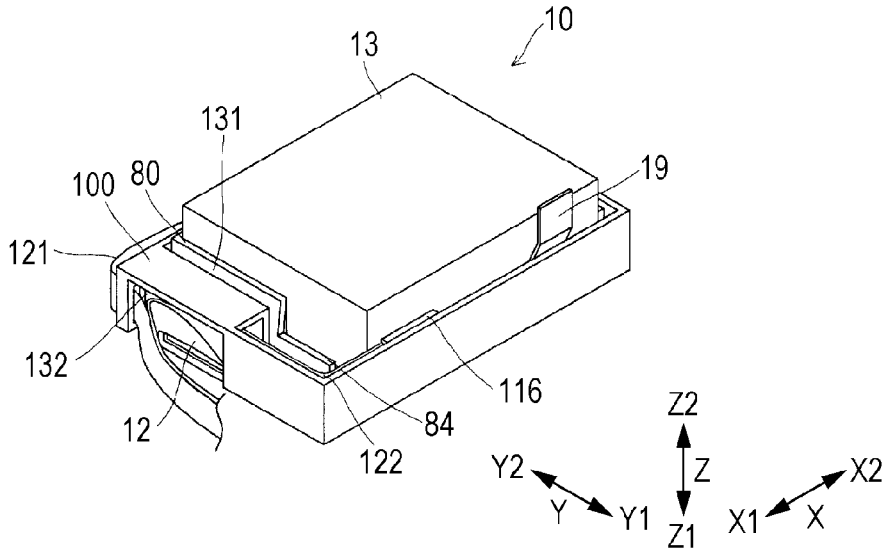
FIG. 4 is a perspective diagram of the ink jet recording head.
Figure 5:
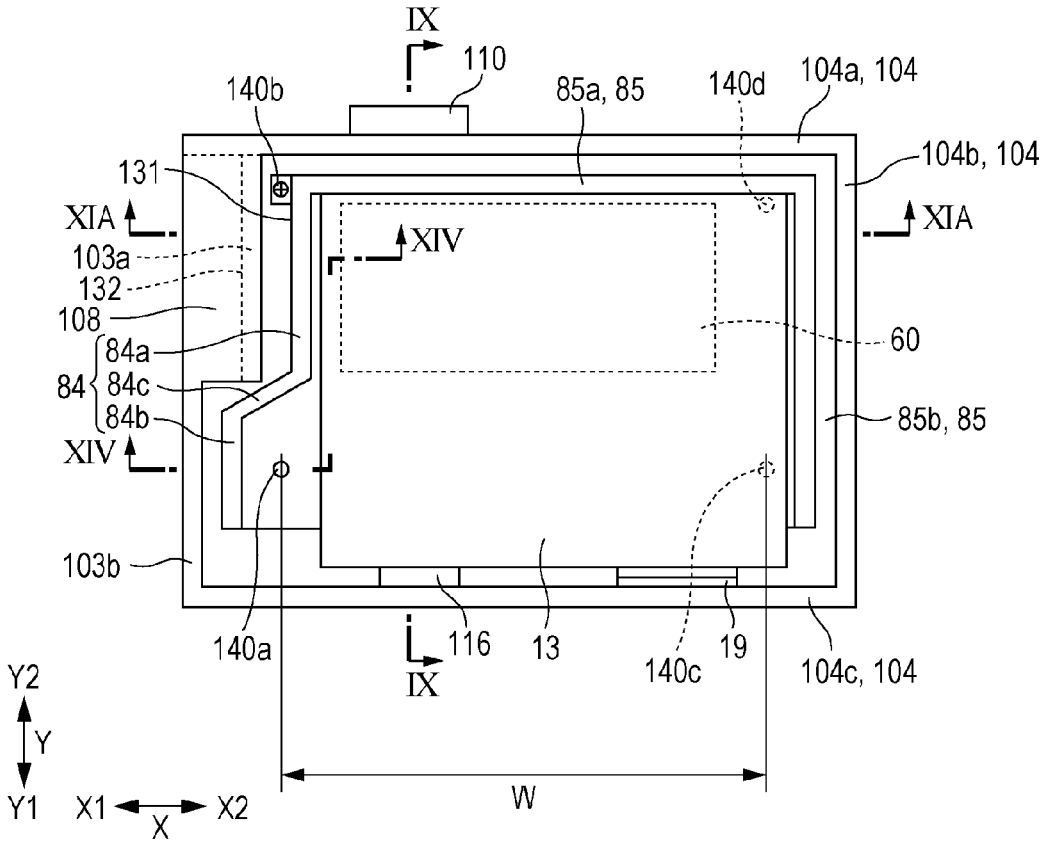
FIG. 5 is a planar diagram of the ink jet recording head.
Figure 6:
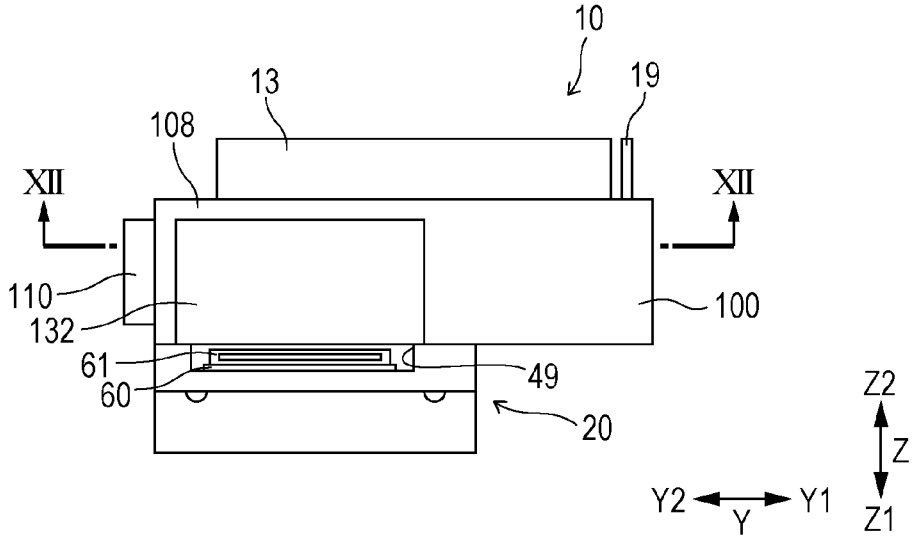
FIG. 6 is a front surface diagram of the ink jet recording head.
Figure 7:
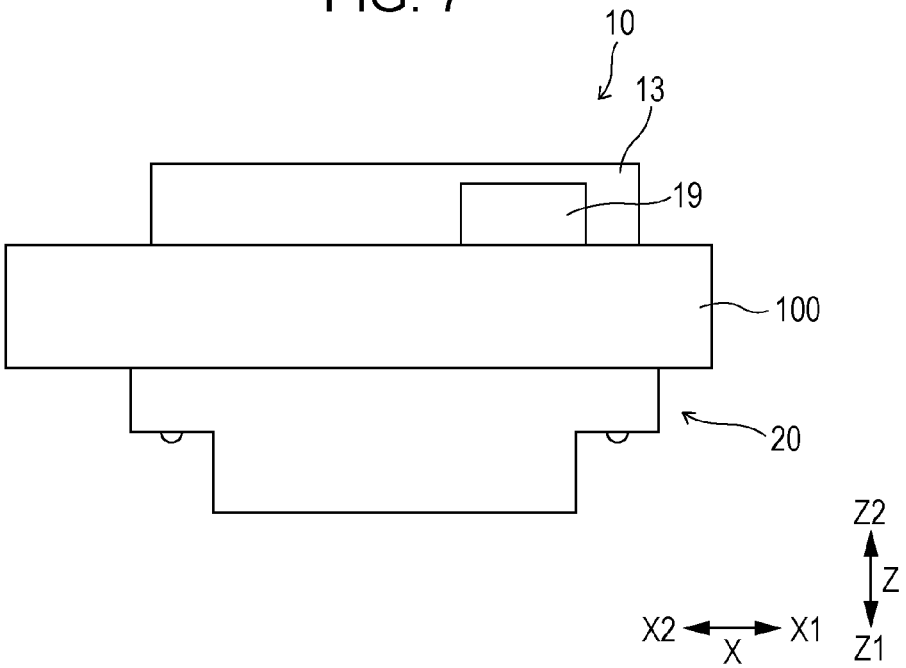
FIG. 7 is a side surface diagram of the ink jet recording head.
Figure 8:
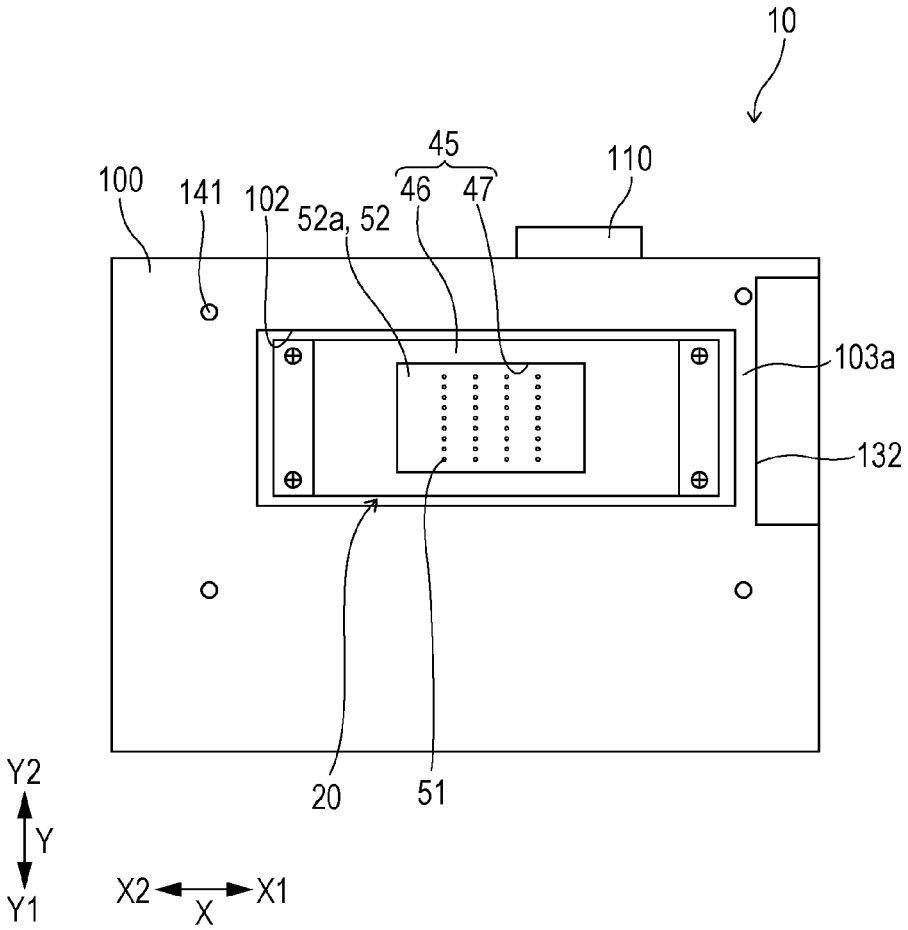
FIG. 8 is a bottom surface diagram of the ink jet recording head.
Figure 9:
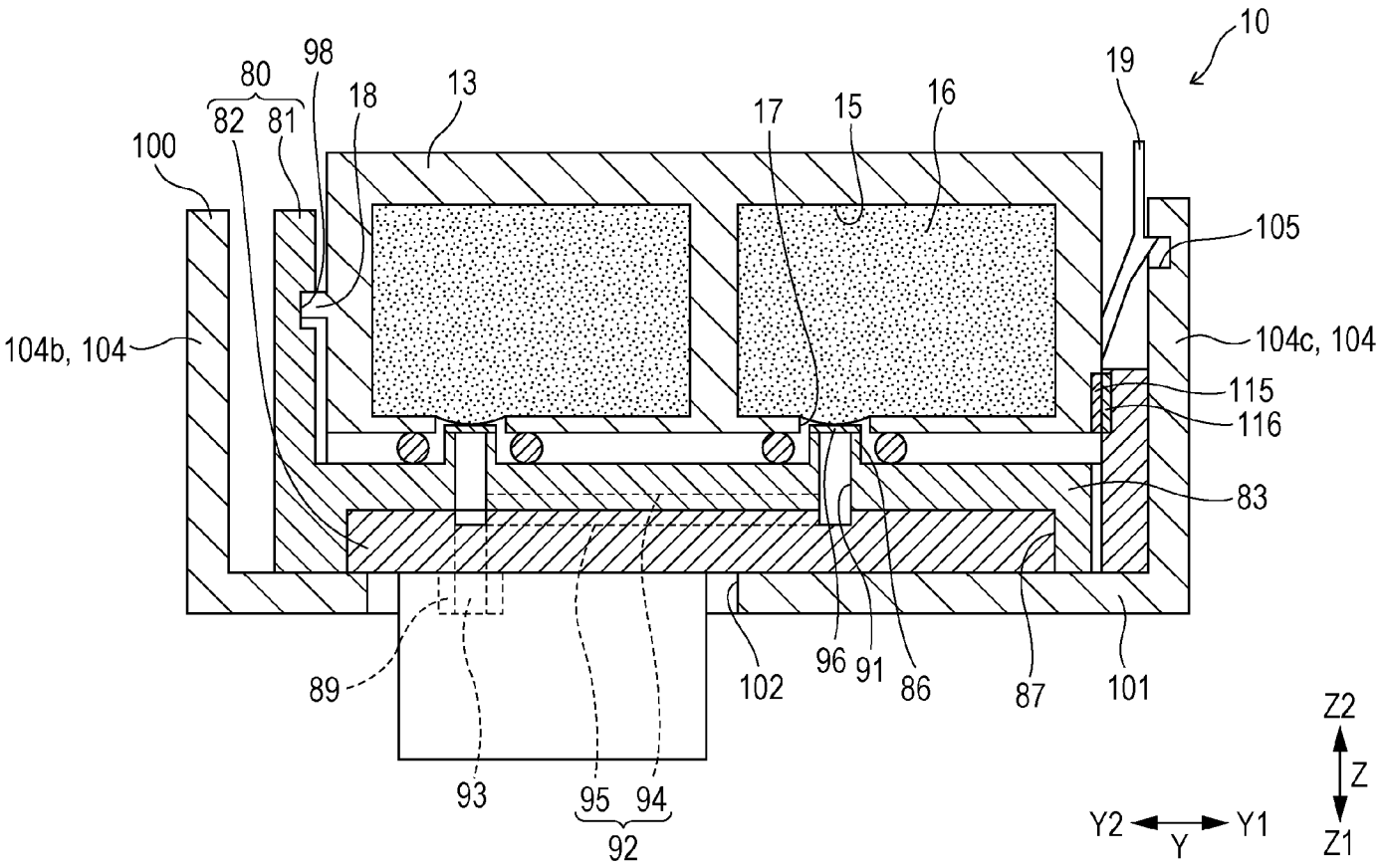
FIG. 9 is a cross sectional diagram along line IX-IX in FIG. 5.

The ink jet recording head 10 will be described in detail. FIG. 3 is an exploded perspective diagram of the ink jet recording head, FIG. 4 is a perspective diagram of the ink jet recording head, FIG. 5 is a planar diagram of the ink jet recording head, FIG. 6 is a front surface diagram of the ink jet recording head, FIG. 7 is a side surface diagram of the ink jet recording head, FIG. 8 is a bottom surface diagram of the ink jet recording head, and FIG. 9 is a sectional diagram along line IX-IX in FIG. 5.

The ink jet recording head 10 includes the head 11 which discharges ink droplets based on data, the signal line 12 which sends the data to the head 11, and a carriage 100 on which the head 11 is mounted.

The head 11 is a member which discharges ink on the recording medium S based on data, and in the present embodiment, includes a head main body 20, a rigid substrate 60, and a supply source fixing member 80.

Figure 10:
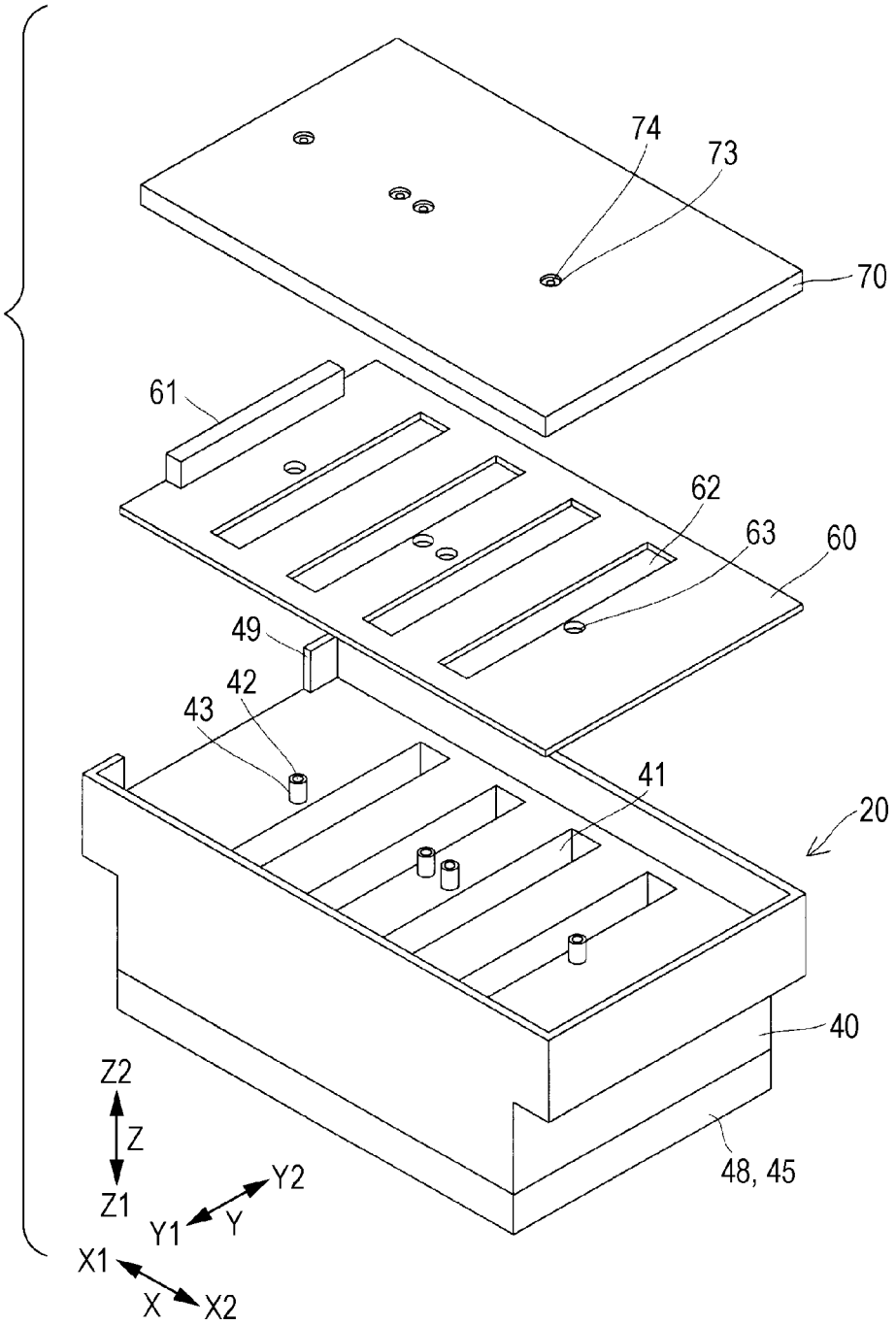
FIG. 10 is an exploded perspective diagram of a head main body.
Figure 11A:
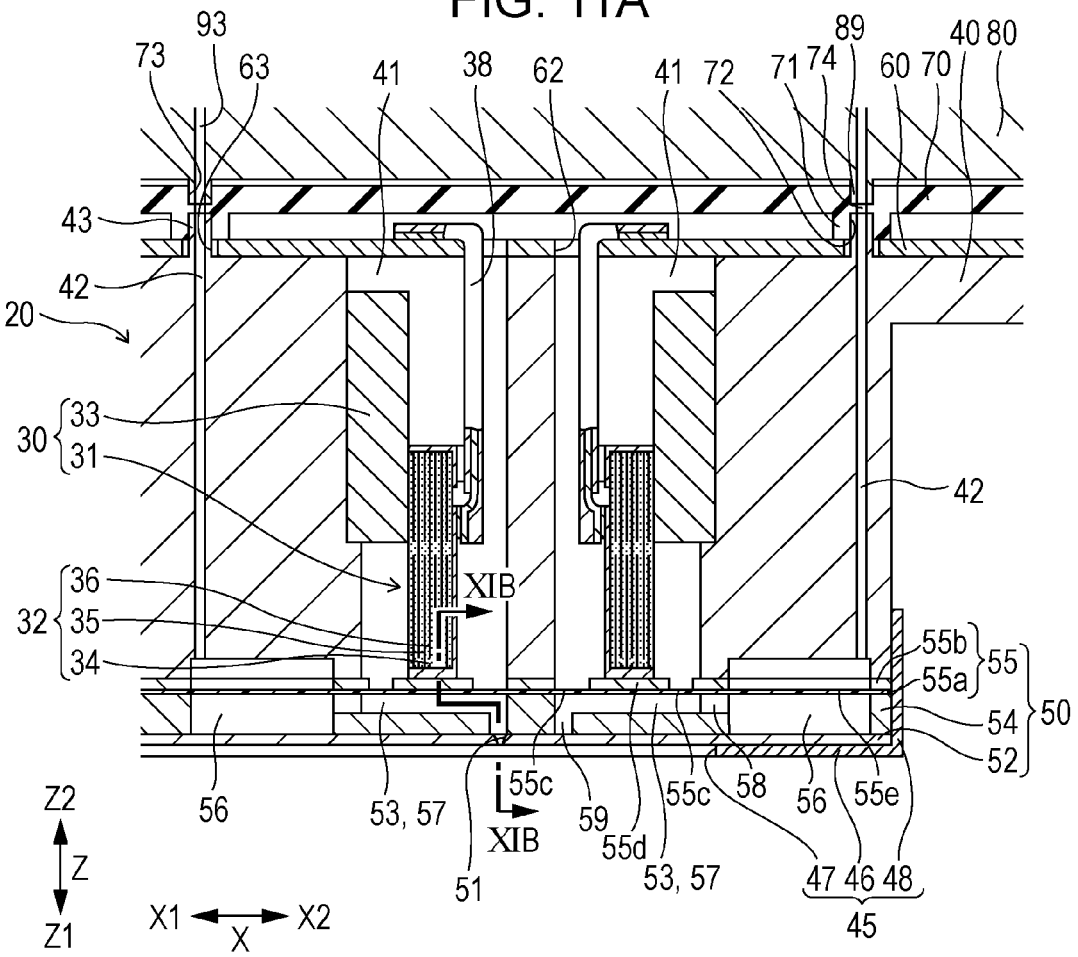
FIG. 11A is sectional diagram along line XIA-XIA in FIG. 5.
Figure 11B:
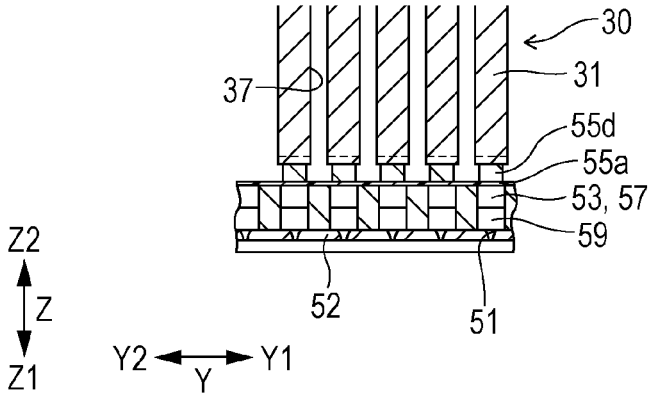
FIG. 11B is a sectional diagram along line XIB-XIB in FIG. 11A.

First, the head main body 20 will be described using FIG. 10 and FIGS. 11A and 11B. FIG. 10 is an exploded perspective diagram of the head main body, FIG. 11A is sectional diagram (along line XIA-XIA in FIG. 5), and FIG. 11B is a sectional diagram along line XIB-XIB in FIG. 11A.

The head main body 20 includes an actuator encoder unit 30 as an example of a driving element, a nozzle plate 52 on which a nozzle 51 is included, and a flow path unit 50 in which a pressure chamber 53 and a manifold 56 are included. In the present embodiment, the head main body 20 includes four actuator encoder units 30, and these are held in a casing 40.

The casing 40 is a member which holds the actuator encoder units 30, and a plurality of accommodating sections 41 are included which are able to accommodate the actuator encoder units 30 inside the casing 40.

The actuator encoder units 30 have a piezoelectric actuator forming member 32 which is lined up in the Y direction by a plurality of piezoelectric actuators 31, and a fixing plate 33 which is joined by a base end section side (an end section on the Z2 side) being set as a fixing end such that a distal end section side (end section on the Z1 side) of the piezoelectric actuator forming member 32 becomes a free end.

The piezoelectric actuator forming member 32 is formed by laminating by alternately interposing a piezoelectric material layer 34, an individual internal electrode 35 which is configured by an internal electrode which configures two poles of the piezoelectric actuator 31, that is an individual electrode that is electrically independent from the adjacent piezoelectric actuator 31, and a common internal electrode 36 which is configured by a common electrode that is electrically common to the adjacent piezoelectric actuator 31.

The piezoelectric actuator forming member 32 is formed by a plurality of slits 37 using a wire saw or the like, and a row of piezoelectric actuators 31 are formed by the distal end section side of the piezoelectric actuator forming member 32 being divided in a comb-tooth shape.

A region where the fixing plate 33 of the piezoelectric actuator 31 is joined is a non-active region that does not contribute to vibration, and only a region at the distal end section side which is not joined to the fixing plate 33 vibrates when voltage is applied between the individual internal electrode 35 and the common internal electrode 36 which configure the piezoelectric actuator 31. Then, the distal end surface of the piezoelectric actuator 31 is fixed to an island section 55*d* of a vibration plate 55, which will be described later, via a fixing agent or the like.

A COF 38, on which a driving circuit such as a driving IC for driving the piezoelectric actuators 31 is mounted, is connected to each piezoelectric actuator 31. Here, the wiring which is connected to the piezoelectric actuator 31 is not limited to the COF 38, and may be an FFC or an FPC.

The flow path unit 50 is equipped with the nozzle plate 52 on which a plurality of nozzles 51 are formed, a flow path forming substrate 54 on which a flow path, that includes the pressure chamber 53 which links the nozzles 51, is formed, and the vibration plate 55 which is fixed to the opposite surface side to the nozzle plate 52 of the flow path forming substrate 54.

In the present embodiment, the manifold 56 which has a common liquid chamber that links the plurality pf pressure chambers 53 is formed on the flow path forming substrate 54.

A plurality of pressure chamber rows 57 are formed by the pressure chamber 53 being divided by a partition wall and are lined up in the Y direction in a surface layer portion on the surface on the casing 40 side on the flow path forming substrate 54. In the present embodiment, four pressure chamber rows 57 are included in the X direction.

In addition, the manifold 56, which is a common liquid chamber that is linked by a plurality of pressure chambers 53 that configure each pressure chamber row 57 being common to each pressure chamber row 57, is included on the flow path forming substrate 54. In the present embodiment, the manifold 56 is included respectively at both sides of two rows of pressure chamber rows 57 in the X direction.

The manifold 56 includes the flow path forming substrate 54 which passes through in the Z direction. In addition, an ink introduction path 42 which is included in the casing 40 is linked to each manifold 56. In addition, the manifold 56 and each pressure chamber 53 are linked via an ink supply path 58. In the present embodiment, the ink supply path 58 is formed with a narrower width than the pressure chamber 53 in the X direction, and flow path resistance of ink is held constant when ink is supplied to the pressure chamber 53 via the ink supply path 58.

Furthermore, a nozzle linking hole 59 which passes through the flow path forming substrate 54 is formed at an end section side that is opposite to the manifold 56 of the pressure chamber 53 in the X direction on the flow path forming substrate 54. A liquid flow path which includes the manifold 56, the ink supply path 58, the pressure chamber 53, and the nozzle linking hole 59 is included on the flow path forming substrate 54. Such a flow path forming substrate 54 consists of a silicon single crystal substrate, and the pressure chamber 53, the manifold 56, or the like which are included on the flow path forming substrate 54 are formed by etching the flow path forming substrate 54.

The nozzle plate 52, on which a plurality of the nozzles 51 which discharge ink are included, is joined to the surface at the Z1 side of the flow path forming substrate 54. Each nozzle 51 is linked to each pressure chamber 53 via the nozzle linking hole 59. In the present embodiment, concerning the nozzles 51, the nozzle rows which configure the nozzles 51 that are lined up in the Y direction, are lined up in four rows in the X direction on the nozzle plate 52 (refer to FIG. 8). In addition, the surface on which ink droplets are discharged on the Z2 side out of both surfaces of the nozzle plate 52, that is, a surface which is on the opposite side to the pressure chamber 53 is set as a nozzle surface 52*a*.

In addition, the vibration plate 55 is joined to the surface at the Z2 side of the flow path forming substrate 54, and each pressure chamber 53 and manifold 56 is sealed by the vibration plate 55.

The vibration plate 55, for example, is formed of a composite substrate of an elastic film 55*a* which consists of an elastic member such as a resin film and a support substrate 55*b* which consists of metal material or the like which supports the elastic film 55*a*, and the elastic film 55*a* side is joined to the flow path forming substrate 54.

A region which opposes a peripheral edge section of each of the pressure chambers 53 of the vibration plate 55 becomes a thin-walled section 55*c* which is practically configured by only the elastic film 55*a* where the support substrate 55*b* is removed. This thin-walled section 55*c* is formed on the surface at the Z2 side of the pressure chamber 53. In addition, the island section 55*d* which consists of a portion of the support substrate 55*b*, on which a distal end of each piezoelectric actuator 31 abuts, is included inside the thin-walled section 55*c*.

A region which opposes the manifold 56 of the vibration plate 55 becomes a compliance section 55*e* which is configured by only the elastic film 55*a* where the support substrate 55*b* is removed. The compliance section 55*e* absorbs pressure variation due to a change of shape when pressure variation is generated inside the manifold 56, and fulfills the role of holding the pressure inside the manifold 56 constant at all times.

The casing 40 is a member which is fixed to the upper surface at the Z2 side of the vibration plate 55, and a plurality of accommodating sections 41 which pass through the Z direction are included. In the present embodiment, four accommodating sections 41 which correspond to the number of pressure chamber rows 57 are included. A fixing plate 33 is fixed to each of four actuator encoder units 30 on an inner surface of each accommodating section 41.

In addition, the ink introduction path 42 is included in the casing 40. The ink introduction path 42 is a flow path for ink from the supply source fixing member 80 on which the ink cartridge 13 is mounted to the manifold 56. A plurality of first projecting sections 43 which face the Z2 side are included on the surface at the Z2 side of the casing 40. The first projecting sections 43 correspond to each of the ink introduction paths 42, and in the present embodiment four are included. The ink introduction path 42 is open to the top surface at the Z2 side of the first projecting section 43.

In addition, a wall surface which protrudes toward the Z2 side is included in the peripheral edge section at the Z2 side of the casing 40, and a portion of the wall surface includes a cut out notch section 49. The rigid substrate 60 and the sealing member 70 are accommodated inside the wall surface at the Z2 side of the casing 40, and the connector 61 which will be described later is exposed from the notch section 49 to the outside.

In such a head main body 20, ink droplets are discharged from each nozzle 51 due to the capacity of each pressure chamber 53 being changed due to a change of shape of the piezoelectric actuator 31 and the vibration plate 55. In detail, when ink is supplied to manifold 56 via the ink introduction path 42, ink is distributed to each pressure chamber 53 which is used in the ejection of ink via the ink supply path 58. Then, pressure variation is generated in the pressure chamber 53 by the piezoelectric actuator 31 being contracted and expanded and ink is ejected from the nozzle 51 due to a voltage being added to or removed from a predetermined piezoelectric actuator 31 using a driving signal from the driving circuit.

The rigid substrate 60 and the sealing member 70 are arranged at the Z2 side of the head main body 20 described above and fixed to the supply source fixing member 80. That is, the rigid substrate 60 and the sealing member are interposed between the head main body 20 and the supply source fixing member 80.

The rigid substrate 60 has the connector 61 (refer to FIG. 3) which the signal line 12 (refer to FIG. 1) is connected to, and the rigid substrate 60 is a substrate which the COF 38 of the head main body 20 is electrically connected to. In the present embodiment, only one connector is included at the Z1 side in the X direction of the rigid substrate 60 ("concerning the rigid substrate, one side in the X direction" in the claims). A terminal of the connector 61 which contacts the signal line 12 is lined up along the Y direction, is arranged at the X1 side of the rigid substrate 60, and is exposed from the notch section 49 of the casing 40. Then, the signal line 12 is inserted into the connector 61 from the X1 side toward the X2 side in the X direction.

In addition, an opening section 62 is formed in a slit shape in a region which opposes the accommodating section 41 of the casing 40 on the rigid substrate 60. In the present embodiment, the rigid substrate 60 has four opening sections 62 which matches the number of accommodating sections 41. Each COF 38 is pulled out from the opening section 62 of the rigid substrate 60 to the outside of the accommodating section 41. The portion which is pulled out from the opening section 62 of the COF 38 is bent toward the surface at the Z2 side of the rigid substrate 60, and is electrically connected to the terminal which is not shown in the drawings.

The rigid substrate 60 to which the signal line 12 and the plurality of COF 38 are connected sends data which indicates a pattern of the ink droplets which are ejected on the recording medium S via the signal line 12 from the control section which is included in the ink jet recording apparatus I. Then, the rigid substrate 60 sends the data to each of the COF 38, and drives each of the actuator encoder units 30 based on the data using the driving IC which is included in the COF 38.

In addition, an insertion hole 63 which passes through a region, in the Z direction, which opposes the first projecting section 43 that is included in the casing 40, is included on the rigid substrate 60. In the present embodiment, four insertion holes 63 are included to match the four first projecting sections 43. The insertion hole 63 is an opening which is larger in diameter than the first projecting section 43, and the first projecting section 43 is inserted inside the insertion hole 63.

The sealing member 70 is arranged at the Z2 side of the rigid substrate 60. A first projecting section 71 which protrudes toward the Z1 side is included at a position which opposes the first projecting section 43 on the surface at the Z1 side of the sealing member 70. In the present embodiment, four first projecting sections 71 are included to match the four first projecting sections 43. In addition, a first fitting section 72 which is formed so as to be engaged with the first projecting section 43 is included in the first projecting section 71.

Meanwhile, a concave second fitting section 73 is included at the Z1 side at a position which opposes the first projecting section 71 on the surface at the Z2 side of the sealing member 70. In the present embodiment, four second fitting sections 73 are included to match the four first projecting sections 71. Here, the second fitting section 73 is formed such that a third projecting section 89, which is included in the supply source fixing member 80 which will be described later, is engaged. In addition, a third flow path 93 which is an ink flow path is open to the surface at the Z1 side of the third projecting section 89.

Furthermore, a linking path 74 which links the first fitting section 72 and the second fitting section 73 is included in the sealing member 70. In the present embodiment, the linking path 74 includes four sets of each of the first fitting sections 72 and the second fitting sections 73.

The first projecting section 43 is engaged with the first fitting section 72, the third projecting section 89 is engaged with the second fitting section 73, and the ink introduction path 42 and the third flow path 93 are linked via the linking path 74. Then, the sealing member 70 is interposed between the supply source fixing member 80 and the casing 40 of the head main body 20 in a state where a predetermined pressing force is applied. For this reason, the ink introduction path 42 and the third flow path 93 are connected in an air-tight state by the sealing member 70.

Although described later in detail, ink from the cartridge 13 is supplied to the flow path which includes the third flow path 93 that includes the supply source fixing member 80. Then, the ink is supplied from the third flow path 93 to the manifold 56 via the linking path 74 and the ink introduction path 42, is distributed to each pressure chamber 53, and is ejected from each nozzle 51.

Here, the head main body 20 further includes a cover head 45. The cover head 45 is a member which covers the side surface of a lower section at the Z1 side of the casing 40 and protects a portion of the nozzle plate 52. For example, the cover head 45 of the present embodiment is formed by an opening section 47 (refer to FIG. 8), which exposes the nozzle 51, and a bent section 48, which is bent at four corners, at a bottom surface section 46 with a square shape consisting of metal such as stainless steel. Such a cover head 45 is fixed to the casing 40 by a member such as a fixing agent or a screw.

As shown in FIG. 3 to FIG. 5 and FIG. 9, the head main body 20 described above is fixed to the supply source fixing member 80.

The supply source fixing member 80 is a member for mounting the ink cartridge 13, and has a flow path on which ink from the ink cartridge 13 is supplied to the head main body 20. The supply source fixing member 80 of the present embodiment is configured from a first fixing member 81 and a second fixing member 82.

The first fixing member 81 is a member on which the ink cartridge 13 is mounted. In detail, the first fixing member 81 includes a base section 83 which is formed with a flat plate shape, a first wall-surface section 84 and a second wall-surface section 85 which are included on the peripheral edge at the Z2 side of the base section 83.

The base section 83 is formed with a flat plate shape and includes a mounting section 86 on which the ink cartridge 13 is mounted on the surface at the Z2 side. In the present embodiment, four mounting sections 86 are included, each mounting section 86 is arranged corresponding to each discharge opening 17 through which ink of each color that is included in one ink cartridge 13 is supplied.

An accommodating section 87 of a size where the second fixing member 82 is engaged is included at the Z1 side of the base section 83. In addition, four first flow paths 91 which pass though in the thickness direction are included in the base section 83. Each of the first flow paths 91 is open to the top surface at the Z2 side of each of the mounting sections 86, and is also open to the bottom surface of the accommodating section 87 (a surface which is opposite to the Z1 side). The filter 96 is included so as cover the opening of the first flow path 91 in each of the mounting sections 86.

The filter 96 is for removing foreign matter and air bubbles which are included in the ink, and includes a plurality of micropores. The filter 96 is fixed to a distal end surface of the mounting section 86, that is, an opening surface where the first flow path 91 is open. The fixing method of the mounting section 86 of the filter 96 is not particularly limited, as long as it is possible to use adhesion, welding, or the like using a fixing agent. In addition, for example it is possible to use a material with a sheet shape where a plurality of micropores are formed by fine weaving or knitting fibers such as metal or resin, or a material where a plurality of micropores are caused to pass through a plate-like member such as metal or resin as the filter 96. Here, the filter 96 may use a non-woven fabric or the like, and the material thereof is not particularly limited. In addition, the filter 96 may be a single layer or may be multi-layer with a plurality of laminated layers.

A first groove section 94 is included at the Z1 side of the base section 83. A plurality of first groove sections 94 are included which correspond to each of the first flow paths 91 which are open to the accommodating section 87, and are linked to each of the first flow paths 91.

The first wall-surface section 84 and the second wall-surface section 85 are portions with a wall shape which are included on the peripheral edge at the Z2 side of the base section 83. The first wall-surface section 84 is included at the X1 side in the X direction of the base section 83, and is formed to extend in the Y direction. Although described later in detail, as shown in FIG. 5, the first wall-surface section 84 forms a first concave section 131 which is included toward the outside of the carriage 100.

The second wall-surface section 85 is not configured by the first concave section 131 out of wall-surface sections which are included in the base section 83. In the present embodiment, a total of two second wall-surface sections, a second wall-surface section 85*a* which is included at the X2 side in the X direction of the base section 83 and extends in the Y direction, and a second wall-surface section 85*b* which is included at the Y2 side in the Y direction of the base section 83 and extends in the X direction, are included in the base section 83. Here, such a second wall-surface section 85 is not formed at the Y1 side in the Y direction of the base section 83. In addition, a first engaging hole 98 which is engaged by a first engaging claw 18 of the ink cartridge 13 which will be described later is included on the surface inside the second wall-surface section 85*a*.

The second fixing member 82 is joined to the first fixing member 81, and is a member which configures a flow path. In detail, the second fixing member 82 is a member which is formed in a flat plate form, and a second groove section 95 is formed so as to oppose the first groove section 94 on the surface at the Z2 side. The first groove section 94 and the second groove section 95 configure a second flow path 92 by the second fixing member 82 which is accommodated in the accommodating section 87 being joined to the first fixing member 81.

A third projecting section 89 which protrudes toward the Z1 side is included at the Z1 side of the second fixing member 82. In the present embodiment, four third projecting sections 89 are included at positions which oppose the first projecting sections 43 which are included in the casing 40. In addition, four third flow paths 93 which pass though in the thickness direction are included on the second fixing member 82. Each of the third flow paths 93 is linked to each of the second groove sections 95 which open to the Z2 side of the second fixing member 82, and are open to the top surface at the Z1 side of each of the third projecting sections 89. In addition, each third flow path 93 is arranged so as to overlap in the Z direction with each of the ink introduction paths 42 which are open to the first projecting section 43 that is included in the casing 40.

A flow path is formed which links the first flow path 91, the second flow path 92, and the third flow path 93 to the supply source fixing member 80 using the first fixing member 81 and the second fixing member 82 described above.

In addition, as shown in FIG. 9, an ink cartridge 13 is mounted on such a supply source fixing member 80. The ink cartridge 13 has a hollow box shape which retains ink (liquid) inside. In the present embodiment, inside the ink cartridge 13 there is a retaining section 15 which is divided into four.

An ink absorption body 16 is included inside each retaining section 15. The ink absorption body 16, for example, is a porous material such as a cotton-like pulp, a polymeric water-absorbing polymer, a urethane foam, or non-woven fabric and includes ink. The discharge opening 17 which is an opening which links each of the retaining sections 15 is included on the bottom surface of the ink cartridge 13, and a portion of the ink absorption body 16 is exposed from each discharge opening 17.

In addition, the first engaging claw 18 and a second engaging claw 19 for fixing the ink cartridge 13 to the supply source fixing member 80 are included on the ink cartridge 13. The first engaging claw 18 is a part with a projecting form which is inserted into the first engaging hole 98 that is included in the second wall-surface section 85*a*. The second engaging claw 19 is included on the surface side opposite to the first engaging claw 18, and is a part with a projecting form which is inserted into the second engaging hole 105 that is a concave section which is formed on the carriage 100 which will be described later. The second engaging claw 19 is fixed to one end section (an end section at the Z1 side) of a side surface at the Y1 side of the ink cartridge 13, and is integrally formed with the ink cartridge 13 such that that the other end section (an end section at the Z2 side) is a free end. In addition, the second engaging claw 19 is able to elastically change shape toward the side surface of the ink cartridge 13.

Such an ink cartridge 13 is mounted on the supply source fixing member 80 and the carriage 100 as follows. First, the ink cartridge 13 is inclined such that the Y2 side in the Y direction is at the Z1 side in the Z direction, and the first engaging claw 18 side is first inserted in the first engaging hole 98 of the second wall-surface section 85*a*.

Next, the ink cartridge 13 is inserted at an inner side which is surrounded by the first wall-surface section and the second wall-surface section 85 by the ink cartridge 13 being rotated with the first engaging claw 18 as a support point in a state where the first engaging claw 18 is inserted in the first engaging hole 98. Thereby, the ink absorption body 16 is connected to the filter 96 via the discharge opening 17.

Then, the second engaging claw 19 elastically changes shape by being pressed on a fourth wall-surface section 104*c* of the carriage which will be described later, is accommodated inside the fourth wall-surface section 104*c*, and the ink cartridge 13 is mounted on the supply source fixing member 80 and the carriage 100 by the second engaging claw 19 engaging with the second engaging hole 105. Here, the shape of the other end section of the second engaging claw 19 is changed at the side of the ink cartridge 13, and it is possible to release the ink cartridge 13 from the supply source fixing member 80 and the carriage 100 by removing the second engaging claw 19 from the second engaging hole 105.

When the ink cartridge 13 is attached to the supply source fixing member 80, ink which is included in each ink absorption body 16 of the ink cartridge 13 is supplied to the first flow path 91 via the filter 96. Then, the ink passes through the first flow path 91 and is led to the Z1 side in the Z direction. Next, the ink is led in the horizontal direction (the direction parallel to the XY horizontal plane) toward the third flow path 93 using the second flow path 92. Then, the ink is led to the ink introduction path 42 via the linking path 74 of the sealing member 70 using the third flow path 93.

As shown in FIG. 3 to FIG. 9 and FIG. 14, the head 11 which includes the head main body 20, the rigid substrate 60, and the supply source fixing member 80 is fixed to the carriage 100.

The carriage 100 is a member on which the head 11 is mounted. In the present embodiment, a bottom surface section 101 in which an opening section 102 is included, and a third wall-surface section 103 and a fourth wall-surface section 104 which are included on the bottom surface section 101 are included.

The bottom surface section 101 is a member with a substantially horizontal shape which is parallel to the XY horizontal plane, and the opening section 102 which the head main body 20 of the head 11 passes through is included.

The third wall-surface section 103 and the fourth wall-surface section 104 are members with a wall shape which are included on a peripheral edge at the Z2 side of the bottom surface section 101. The third wall-surface section 103 is included at the X1 side in the X direction of the bottom surface section 101, and is formed extending in the Y direction. Although described later in detail, the third wall-surface section 103 forms a second concave section 132 which is included toward the outside of the carriage 100.

The fourth wall-surface section 104 is not configured by the second concave section 132 out of wall-surface sections which are included on the bottom surface section 101. In the present embodiment, a total of three fourth wall-surface sections, a fourth wall-surface section 104*a* which is included at the X2 side in the X direction of the bottom surface section 101 and extends in the Y direction, a fourth wall-surface section 104*b* which is included at the Y1 side in the Y direction of the bottom surface section 101 and extends in the X direction, and a fourth wall-surface section 104*c* which is included at the Y2 side in the Y direction of the bottom surface section 101 and extends in the X direction are included on the bottom surface section 101. In addition, the second engaging hole 105 which is engaged with the second engaging claw 19 of the ink cartridge 13 is included on the surface inside the fourth wall-surface section 104*c*.

The head 11 is fixed to such a carriage 100. In detail, a first screw hole 142 and a second screw hole 143 which are fastened by a screw 140 that is an example of a fixing member are included in the bottom surface section 101 of the carriage 100 and the base section 83 of the supply source fixing member 80. Then, the head 11 is fixed to the carriage 100 by the screw 140 passing through the first screw hole 142 and the second screw hole 143 and being fastened by a nut 141 in a state where the head main body 20 of the head 11 passes through from the Z2 side toward the Z1 side in the opening section 102, and a surface at the Z1 side of the supply source fixing member 80 is mounted on a surface at the Z2 side of the bottom surface section 101.

Such a carriage 100 is attached so as able to move along the carriage shaft 3 of the ink jet recording apparatus I. In addition, the linear encoder 110 which reads the linear scale 2 is included in the carriage 100. A first wiring 121 such as the FFC is connected to the linear encoder 110. The first wiring 121 is folded in the ink jet recording head 10, is gathered with the signal line 12 or a second wiring 122 which will be described later, and is connected to the control section of the ink jet recording apparatus I.

In addition, the second terminal section 116 which electrically contacts the first terminal section 115 of the ink cartridge 13 is included inside the fourth wall-surface section 104*c* in the carriage 100. When the ink cartridge 13 is fixed to the supply source fixing member 80 of the head 11, the first terminal section 115 and the second terminal section 116 are set so as to electrically contact. The second wiring 122 such as the FFC is connected to the second terminal section 116. The second wiring 122 is folded in the ink jet recording head 10, is gathered with the signal line 12 or the first wiring 121, and is connected to the control section of the ink jet recording apparatus I.

Information on the remaining amount of ink which is detected by the positional information of the carriage 100 and the ink cartridge 13 is sent to the control section using such a first wiring 121 and second wiring 122. Here, the aspect where the first wiring 121 and the second wiring 122 are folded and gathered along with the signal line 12 will be described later.

The head 11 which is fixed to the carriage 100 described above is connected to the connector 61 of the rigid substrate 60 by the signal line 12.

The signal line 12 is a member which includes a wiring that sends data to the head 11 which discharges ink droplets based on the data. The signal line 12 is not particularly limited as long as the member includes a wiring that is able to send data, but for example, it is possible to use a flexible flat cable (FFC). Here, the signal line 12 is not limited to a wiring which sends data to the head 11, and may include a wiring which sends information that relates to the head 11 to the control section or the like.

Such a signal line 12 is folded in the ink jet recording head 10 and is connected to the control section of the ink jet recording apparatus I. In addition, in the present embodiment, as well as the signal line 12, the first wiring 121 and the second wiring 122 are also folded, gathered with the signal line 12 and connected to the control section.

Figure 12:
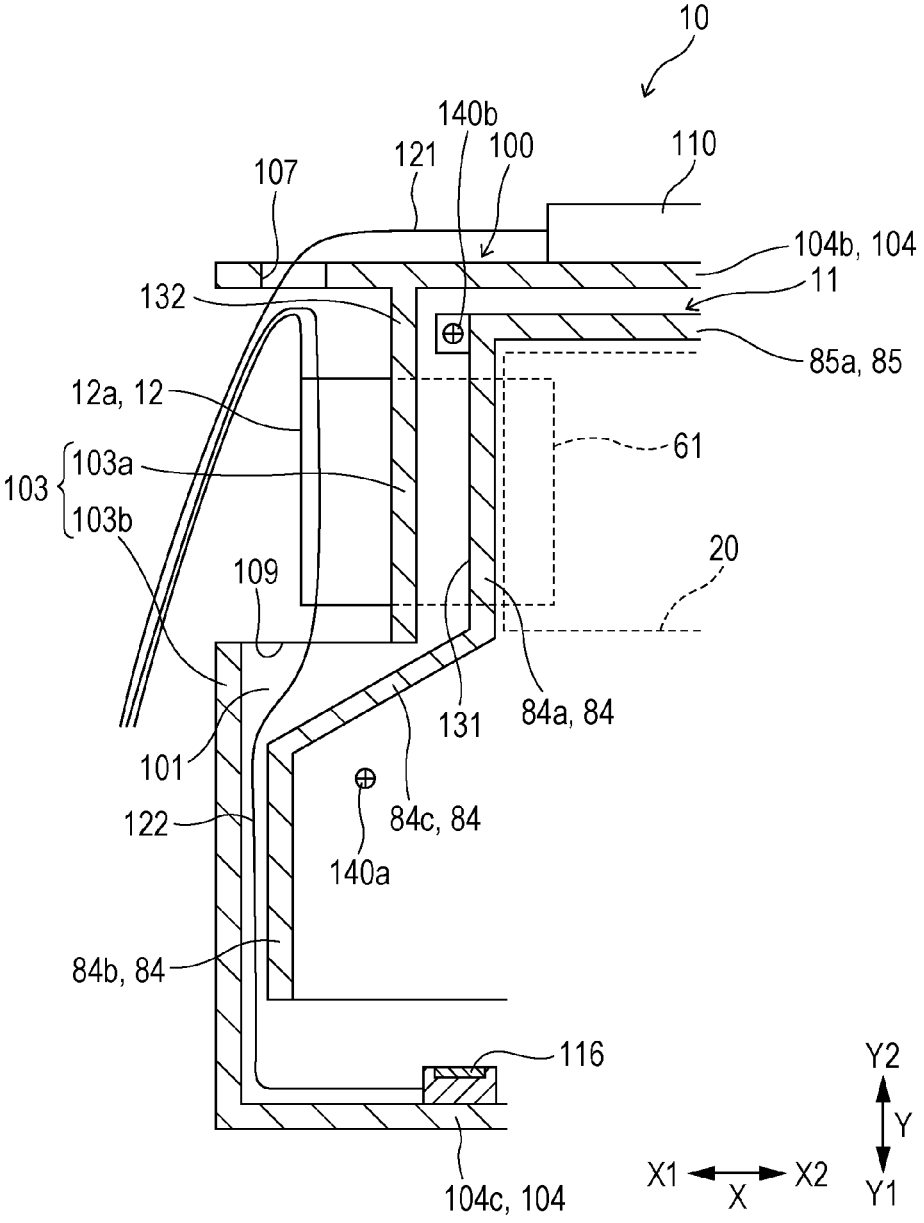
FIG. 12 is a sectional diagram along line XII-XII in FIG. 6.
Figure 13:
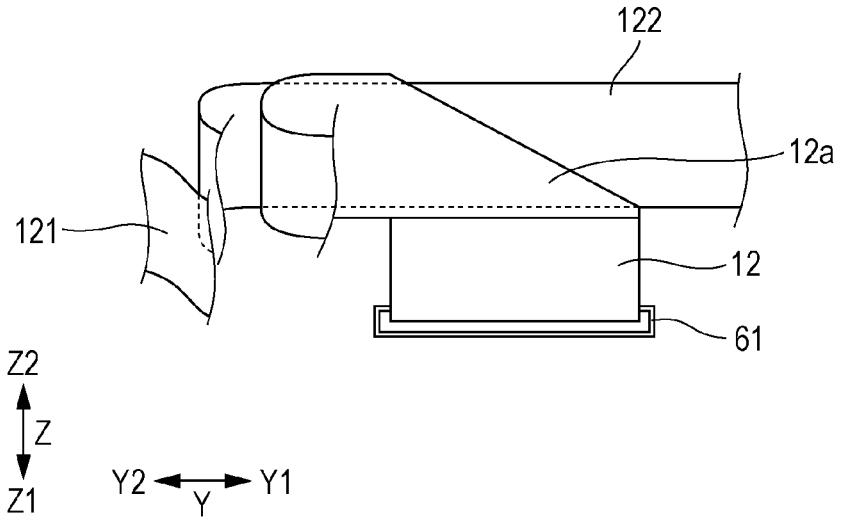
FIG. 13 is front surface diagram of a signal line, a first wiring, and a second wiring.

Here, an aspect where the signal line 12, the first wiring 121, and the second wiring 122 are folded will be described using FIG. 4 and FIG. 5, and FIG. 12 and FIG. 13. FIG. 12 is a sectional diagram along line XII-XII in FIG. 6 illustrating main part of the ink jet recording head, and FIG. 13 is front surface diagram of the signal line, the first wiring, and the second wiring.

The first concave section 131 and the second concave section 132 are included toward the outside of the carriage 100 in the ink jet recording head 10.

The first concave section 131 and the second concave section 132 are parts which accommodate the signal line 12 out of the ink jet recording head 10, and are included toward the outside of the carriage 100. When the first concave section 131 and the second concave section 132 are included toward the outside of the carriage 100, the opening portion is positioned toward the outside of the carriage 100. In addition, when the first concave section 131 and the second concave section 132 accommodate the signal line 12, a portion of the signal line 12 which is connected to the connector 61 is arranged inside the first concave section 131 and the second concave section 132.

In the present embodiment, the first concave section 131 is formed by indenting a portion of the first wall-surface section 84 which configures the head 11 at the X2 side. In detail, the first wall-surface section 84 is provided with a first portion 84*a*, a second portion 84*b*, and a third portion 84*c*. The first portion 84*a* is a portion at the Y2 side in the Y direction of the first wall-surface section 84, the second portion 84*b* is a portion at the Y1 side in the Y direction of the first wall-surface section 84, and the third portion 84*c* is a portion which connects the first portion 84*a* and the second portion 84*b*.

The first portion 84*a* is arranged further to the X2 side in the X direction than the second portion 84*b*. That is, the first portion 84*a* configures the first concave section 131 by being arranged further to the X2 side than the second portion 84*b* in the X direction of the head 11.

In addition, the second concave section 132 is formed by indenting a portion of the third wall-surface section 103 which configures the carriage 100 at the X2 side. In detail, the third wall-surface section 103 is provided with a fourth portion 103*a* and a fifth portion 103*b*. The fourth portion 103*a* is arranged further to the X2 side than the fifth portion 103*b* in the X direction, and is arranged further to the Y2 side than the fifth portion 103*b* in the Y direction. That is, the fourth portion 103*a* configures the second concave section 132 by being arranged further to the X2 side than the fifth portion 103*b* in the X direction of the carriage 100.

Here, an insertion hole 107 is provided in a portion further to the X1 side than the fourth portion 103*a* in the X direction out of the fourth wall-surface section 104*b*. The insertion hole 107 is an opening into which the first wiring 121 is inserted.

In addition, a ceiling section 108 is provided at a portion at the Y2 side out of a top surface at the Z2 side of the fourth portion 103*a* and a top surface of the fifth portion 103*b*, and at a portion at the X1 side out of the top surface of the fourth wall-surface section 104*b*. The ceiling section 108 configures a surface at the Z2 side of the second concave section 132. In addition, the insertion hole 109 is formed by the bottom surface section 101, the ceiling section 108, and the fourth portion 103*a* and the fifth portion 103*b* which are erected therebetween. The insertion hole 109 is an opening into which the second wiring 122 is inserted.

In this manner, the concave section which is included in the ink jet recording head 10 according to the present embodiment corresponds to the first concave section 131 and the second concave section 132. That is, the first concave section 131 and the second concave section 132 which are provided toward the outside of the carriage 100 are open to the X1 side where the first concave section 131 and the second concave section 132 are at the outside of the carriage 100. In addition, the first concave section 131 and the second concave section 132 which accommodate the signal line 12 accommodate the signal line 12 inside the second concave section 132 (that is, even inside the first concave section 131). Hereafter, the signal line 12 is accommodated in either of the first concave section 131 and the second concave section 132.

As shown in FIGS. 11A and 11B and FIG. 12, one end side of the signal line 12 is mounted in the connector 61 substantially parallel to the XY horizontal plane. The other end side is folded at the Z2 side in the Z direction inside the second concave section 132.

Meanwhile, the other end side of the signal line 12 is folded diagonally in the YZ horizontal plane and is folded toward the Y2 side in the Y direction and further opposite to the Y1 side. In this manner, the portion of the signal line 12 which is folded inside the second concave section 132 is referred to as a folded portion 12*a*. The signal line 12 is folded inside the second concave section 132, then is pulled out to the outside of the second concave section 132 and is connected to the control section of the ink jet recording apparatus I. Here, the folded portion 12*a* is an example of "a portion of the signal line which is accommodated in the concave section" in the claims. It is obvious that, the manner of folding of the signal line 12 is not limited to such an aspect.

In this manner, the position of the folded portion 12*a* which is arranged inside the second concave section 132 overlaps with a position of at least a portion of the carriage 100 and overlaps with at least a portion of the head 11 in the X direction.

In the present embodiment, the folded portion 12*a* overlaps with a portion of the carriage 100 in the X direction between the fourth portion 103*a* and the fifth portion 103*b*. In addition, the folded portion 12*a* overlaps with the supply source fixing member 80 which is a portion of the head 11 in the X direction between the first portion 84*a* and the second portion 84*b*.

In other words, the first concave section 131 and the second concave section 132 are provided further to the X2 side than the fifth portion 103*b* which is a part that is positioned furthest to the X1 side in the X direction of the ink jet recording head 10. It is possible to arrange the folded portion 12*a* which is accommodated inside the first concave section 131 and the second concave section 132 at a position which overlaps with a portion of the carriage 100 and the head 11 in the X direction since such a first concave section 131 and a second concave section 132 are included.

Here, if it is assumed that a position where the folded portion 12*a* does not overlap with the carriage 100 in the X direction, for example, is set to be arranged further to the X1 side than the third wall-surface section 103. In this case, since the folded portion 12*a* is further to the X1 side than the carriage 100, the size of the ink jet recording head 10 which includes the folded portion 12*a* is increased in the X direction in the width which the folded portion 12*a* occupies in the X direction. Alternatively, in a case where a member such a cover for preventing the folded portion 12*a* from coming into contact with another member is attached to the carriage 100, the size of the ink jet recording head 10 is increased in the width which the member occupies in the X direction.

However, according to the ink jet recording head 10 as in the present embodiment described above, the folded portion 12*a* of the signal line 12 which is accommodated in the first concave section 131 and the second concave section 132 is arranged at a position which overlaps with a portion of the carriage 100 and the head 11 in the X direction. That is, it is possible to avoid the width that the folded portion 12*a* occupies in the X direction increasing in size and it is possible to realize a reduction in size of the ink jet recording head 10.

In addition, here if it is assumed that a configuration where the head 11 is moved to the X2 side and does not overlap with the folded portion 12*a* in the X direction, that is, a configuration where the folded portion 12*a* only overlaps with the carriage 100 and does not overlap with the head 11 is set. In detail, the head 11 is positioned further to the X2 side than the fourth portion 103*a* of the carriage 100 in the X direction. In such a configuration, the carriage 100 requires a width that is equal to or more than the sum of both of the width of the second concave section 132 and the width of the head 11 in the X direction and increases in size.

However, according to the ink jet recording head 10 as in the present embodiment described above, the folded portion 12*a* overlaps with not only the carriage 100, but also the head 11 in the X direction. That is, since the second concave section 132 which accommodates the folded portion 12*a* overlaps with the head 11 in the X direction, the carriage 100 may be formed so as to match the width of the head 11 in the X direction, and it is possible to reduce the size in the width of the second concave section 132. Thereby, it is possible to realize a reduction in size of the ink jet recording head 10 in the X direction.

Furthermore, according to the ink jet recording head 10 as in the present embodiment, the connector 61 which is connected to the signal line 12 is lined up with the terminal in the Y direction. Thereby, it is possible to provide the ink jet recording head 10 further reduced in size in the X direction than in a case where the connector which is lined up with the terminal in the X direction is adopted.

In addition, the ink jet recording head 10 as in the present embodiment accommodates not only the signal line 12 in the second concave section 132, but also first wiring 121 and second wiring 122. In detail, the other end side of the first wiring 121 where one end is connected to the linear encoder 110 is inserted into the insertion hole 107, and that portion is accommodated inside the second concave section 132.

Meanwhile, the other end side of the second wiring 122 where one end is connected to the second terminal section 116 is inserted between the second portion 84*b* and the fifth portion 103*b* and into the insertion hole 109, and that portion is accommodated inside the second concave section 132.

The first wiring 121 and the second wiring 122 which are accommodated in the second concave section 132 in this manner are gathered with the signal line 12 and connected to the control section of the ink jet recording apparatus I. In this manner, not only the signal line 12, but also a wiring such as the first wiring 121 or the second wiring 122 which are connected to the ink jet recording head 10 may be accommodated in the second concave section 132. The width further increases in the X direction due to using the signal line 12 and a plurality of wirings, but it is possible to avoid an increase in width of the ink jet recording head 10 in the X direction since the signal line and the plurality of wirings are accommodated in the second concave section 132.

In addition, since the signal line 12 is accommodated in the second concave section 132, it is possible to suppress exposure of the signal line 12 and suppress ink from unintentionally adhering to the signal line 12.

In this manner, since the ink jet recording head 10 is reduced in size in the X direction, it is possible to reduce the size in the X direction even of the ink jet recording apparatus I which is provided with the ink jet recording head 10.

Figure 14:
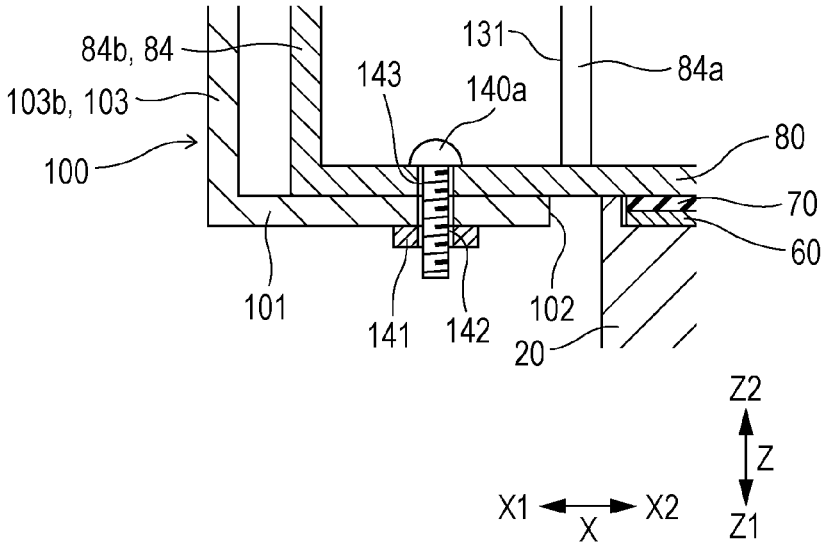
FIG. 14 is a sectional diagram along line XIV-XIV in FIG. 5.

In addition, the fixing member which fixes the head 11 to the carriage 100 will be described using FIG. 5 and FIG. 14. FIG. 14 is a sectional diagram along line XIV-XIV in FIG. 5.

The ink jet recording head 10 includes the screw 140 and the nut 141 which are an example of the fixing member which fixes the head 11 to the carriage 100.

The first screw hole 142 into which the screw 140 is inserted is included in the bottom surface section 101 of the carriage 100. In the present embodiment, a total of four first screw holes 142 are provided respectively at the four corners of the carriage 100. It is obvious that the position at which the screws 140 are included and the number thereof is not limited to this aspect.

In addition, the second screw hole 143 into which the screw 140 is inserted is included in the supply source fixing member 80. In the present embodiment, four second screw hole 143 are included, and are included to oppose each of the first screw holes 142. The screws 140 are inserted into each first screw hole 142 and second screw hole 143 from the Z2 side of the supply source fixing member 80 and are fastened to the nut 141 at the surface on the Z1 side of the carriage 100. The four screws 140 are also individually referred to as a screw 140*a*, a screw 140*b*, a screw 140*c*, and a screw 140*d*.

The screw 140*a* and the screw 140*b* are at substantially the same position in the X direction, and the screw 140*a* is positioned at the Y1 side in the Y direction and the screw 140*b* is positioned at the Y2 side in the Y direction. In addition, the screw 140*c* and the screw 140*d* are positioned more to the X2 side in the X direction than the screw 140*a* and the screw 140*b*, and the screw 140*c* is positioned at the Y1 side in the Y direction and the screw 140*d* is positioned at the Y2 side in the Y direction.

A position in the X direction of the first concave section 131 which accommodates the signal line 12 described above and a position in the X direction of the screw 140*a* and the screw 140*b* which are the fixing member overlap with one another. In detail, the screw 140*a* and the screw 140*b* are positioned more to the X1 side in the X direction than the first portion 84*a* which configures the first concave section 131. Here, in a case where in the manner of the present embodiment the first concave section 131 which is formed by the head 11 and the second concave section 132 which is formed by the carriage 100 are present, it is sufficient if at least one overlaps with the fixing member in the X direction.

It is possible to arrange the screw 140*a* and the screw 140*b* further to the outside in the X direction, and it is possible to easily positionally align the head 11 and the carriage 100 due to such a position in the X direction of the first concave section 131 which accommodates the signal line 12 and a position in the X direction of the screw 140*a* and the screw 140*b* overlapping with one another.

In addition, the first concave section 131 which is able to accommodate the signal line 12 is arranged further to the inside in the X direction than the screw 140*a* and the screw 140*b*. That is, the first portion 84*a* which configures the first concave section 131 is arranged further to the inside (that is, the X2 side) of the head 11 than the screw 140*a* and the screw 140*b*. Thereby, since it is possible to arrange the first concave section 131 further to the inside than the head 11, it is possible to reduce the size of the head 11 in the X direction.

In addition, although not particularity shown in the drawings, the fourth portion 103*a* which configures the second concave section 132 may be arranged further to the inside (that is, the X2 side) of the carriage 100 than the screw 140*a* and the screw 140*b*. Thereby, it is possible to arrange the second concave section 132 further to the inside than the carriage 100 and it is possible to reduce the size of the carriage 100 in the X direction.

In addition, as shown in FIG. 14, the rigid substrate 60 is fixed between the head main body 20 and the supply source fixing member 80. Then, any of the screw 140*a* to the screw 140*d* which are fixing members fix the supply source fixing member 80 and the carriage 100 at a position which does not pass through the rigid substrate 60. That is, the screws 140 fix the supply source fixing member 80 and the carriage 100 at a position not overlapping with the rigid substrate 60 on the XY horizontal plane.

Regardless of the length of the screws 140 in the Z direction it is possible to narrow a gap between the supply source fixing member 80 and the carriage 100 in the Z direction by fixing the supply source fixing member 80 and the carriage 100 at a position in the manner where the screws 140 do not overlap with the rigid substrate 60. Thereby, it is possible to reduce the size of the ink jet recording head 10 in the Z direction. In addition, it is possible to secure a space for securing the rigid substrate between the head main body 20 and the supply source fixing member 80 regardless of the length of the screws 140 in the Z direction.

In addition, a gap between the supply source fixing member 80 and the carriage 100 is narrowed by more than the length of the screws 140 in the Z direction. In the present embodiment, a surface at the Z1 side of the supply source fixing member 80 and a surface at the Z2 side of the carriage 100 come into contact, and the gap is practically zero. It is possible to reduce the size of the ink jet recording head 10 in the Z direction since it is possible to narrow the gap between the supply source fixing member 80 and the carriage 100 more than the length of the screws 140. In addition, as described above, since the screws 140*a* to 140*d* are at a position not overlapping with the rigid substrate 60, the screws 140 do not need to have a length which takes into account the length of the rigid substrate in the Z direction and it is possible to use general purpose length screws.

In addition, as shown in FIG. 5, a gap W between the screws 140 at the outermost side in the X direction is 0.8 to 1.1 with respect to the dimension of the rigid substrate 60 in the X direction. In the present embodiment, the outermost screws 140 are the screw 140*a* and the screw 140*b* at the X1 side and the screw 140*c* and the screw 140*d* at the X2 side. Between a parallel line which the screw 140*a* (or the screw 140*b*) passes through in the Y direction and a parallel line which the screw 140*c* (or the screw 140*d*) passes through in the Y direction is the gap W between the screws 140 at the outermost side. In the present embodiment, the gap W is wider than the width of the rigid substrate 60 in the X direction and is 1.1 times the dimension, that is, the width of the rigid substrate 60 in the X direction.

Here, the rigid substrate 60 is electrically connected to one end of the COF 38 which is connected to each actuator encoder unit 30. The COF 38 includes the same number of wirings as the number of nozzles, and it is also necessary to provide a number of terminals corresponding to the number of nozzles on the rigid substrate 60.

In the ink jet recording head 10 as in the present embodiment, the gap W between the screws 140 at the outermost side in the X direction is set at 0.8 to 1.1 with respect to the dimension of the rigid substrate 60. Thereby, since it is possible to secure sufficient dimensions for the rigid substrate 60, the number of nozzles as described above increases and it is possible to avoid it being difficult to mount the wiring pattern on the rigid substrate 60 even if the number of terminals which the COF 38 connects increases.

In addition, as shown in FIG. 10, the connector 61 is arranged on the rigid substrate 60 only at the X1 side which is one side in the X direction. Thereby, it is possible to reduce the size in the X direction of the rigid substrate 60 as in the present embodiment more than a rigid substrate which includes a plurality of the connectors 61 on both sides in the X direction, that is, both sides of the X1 side and the X2 side.

In addition, although not particularly illustrated, a plurality of IC chips are arranged on the rigid substrate 60. The IC chips are mounted between the terminal and the connector 61 which the COF 38 of the rigid substrate 60 connects. It is preferable if 90 to 100% out of the entirety of the IC chips which are mounted on the rigid substrate 60 are arranged on the XY horizontal plane between the connector 61 and the actuator encoder unit 30, in other words the terminal which the COF 38 of the rigid substrate 60 connects. Thereby, since out of the rigid substrate 60, IC chips are arranged centrally between the actuator encoder unit 30 and the terminal, it is possible to reduce the region on the rigid substrate 60 where the IC chips are not arranged, and thereby it is possible to reduce the size of the rigid substrate 60.

Other Embodiments

An embodiment of the invention is described above, but the basic configuration of the invention is not limited to that described above.

For example, the folded portion 12*a* of the signal line 12 is accommodated in the first concave section 131 and the second concave section 132 of the ink jet recording head 10 described above, but the invention is not limited to such an aspect, and it is not necessary for the signal line 12 to be folded. It is sufficient if a portion of the signal line is accommodated in at least one of the first concave section 131 and the second concave section 132, and the signal line 12 need not be folded.

In addition, the ink jet recording head 10 includes the first concave section 131 in the head 11, and the second concave section 132 in the carriage 100, but the invention is not limited to such an aspect. For example, the configuration may be such that the first concave section 131 is included only in the head 11, the third wall-surface section 103 of the carriage 100 is not included, and the first concave section 131 is positioned toward the outside of the carriage 100. Alternatively, the configuration may be set such that only the second concave section 132 is included in the carriage 100 and the first concave section 131 is not included in the head 11. That is, a concave section which accommodates the signal line 12 may be set where either the first concave section 131 or the second concave section 132 are included toward the outside of the carriage 100.

In the ink jet recording head 10 described above, the ink cartridge 13 which is a liquid supply source is mounted on the supply source fixing member 80, but the invention is not limited to such an aspect. For example, there may be a configuration where the ink cartridge 13 is fixed to the apparatus main body 1 and ink is supplied from the ink cartridge 13 which is fixed to the apparatus main body 1 to the ink jet recording head 10 via a tube.

In the ink jet recording head 10 described above, in addition to the signal line 12, the first wiring 121 and second wiring 122 are accommodated in the first concave section 131 and the second concave section 132, but the invention is not limited to such an aspect. That is, the first wiring 121 and second wiring 122 may not be accommodated in the first concave section 131 or the second concave section 132. In addition, the first wiring 121 and second wiring 122 may not be provided. Furthermore, there is one signal line 12, but there may be a plurality.

In the ink jet recording head 10 described above, there are four colors of ink and four flow paths are formed on the supply source fixing member 80 corresponding to the four colors of ink, and a nozzle row corresponding to each color and four actuator encoder units 30 which are each provided with each nozzle row are included, but the invention is not limited to such an aspect. That is, in the ink jet recording head 10 of the invention, the color and the type of the ink and the number of actuator encoder units 30 is not limited.

Furthermore, a vertical vibration type actuator encoder unit 30 which alternately laminates and expands in the axial direction a piezoelectric material and an electrode forming material is used a pressure generating means which generates pressure variation in the pressure chamber 53, but the pressure generating means is not particularly limited thereto, and for example, it is possible to use a thick-film type piezoelectric actuator, a thin-film type piezoelectric actuator, or the like which is formed using a method such as pasting a green sheet. In addition, it is possible to use a means which discharges liquid droplets from a nozzle opening using bubbles which are generated due to heat from a heat generating element by arranging the heat generating element inside the pressure chamber, a so-called electrostatic type actuator which generates static electricity between a vibration plate and an electrode and discharges liquid droplets from the nozzle opening by changing the shape of the vibration plate using electrostatic force, or the like as the pressure generating means.

Here, in the aspect of the embodiment described above, an ink jet recording head is given as an example of a liquid ejecting head and an ink jet recording apparatus is given as an example of a liquid ejecting apparatus, but the object of the invention is a liquid ejecting head and a liquid ejecting apparatus in general which has widespread liquid ejecting heads, and it is possible to carry out obvious applications to a liquid ejecting head and liquid ejecting apparatus which eject liquid other than ink. Various types of recording heads which are used in an image recording apparatus such as a printer, a color material ejecting head which is used in production of color filters such as a liquid crystal display, an electrode material ejecting head which is used in an electrode formation such as an organic EL display or an FED (a field emission display), a biological substance ejecting head which is used in the production of bio chips, or the like are given as examples of other liquid ejecting heads, and application is also possible to a liquid ejecting head and a liquid ejecting apparatus including those liquid ejecting heads.

What is claimed is:

1. A liquid ejecting head comprising:

a head configured to discharge liquid from a nozzle on a nozzle surface based on data;

a signal line configured to send head data via a connector of the head;

a carriage on which the head is mounted; and a concave section which is provided at a side surface of the liquid ejecting head and which accommodates the signal line, the concave section being open toward the outside of the carriage, wherein in a case where an X direction, a Y direction, and a Z direction are orthogonal to one another, and the carriage is configured to move relative to a discharge medium in the X direction and the nozzle surface is specified as the XY horizontal plane, the signal line is connected to the connector with terminals linearly lined up in the Y direction, and the terminals are provided at the side surface of the liquid ejecting head, and a position of a portion of the signal line which is accommodated in the concave section overlaps with a position of a portion of at least the carriage in the X direction, and overlaps with a portion of at least the head in the X direction.

2. The liquid ejecting head according to claim 1, further comprising:

a fixing member which fixes the head to the carriage, wherein the position in the X direction of the concave section which accommodates the signal line and the position in the X direction of the fixing member overlap with one another.

3. The liquid ejecting head according to claim 2, wherein the head includes:

a head body which has a driving element, the nozzle, a pressure chamber, and a manifold;

a rigid substrate which has the connector and is electrically connected to the head body; and a supply source fixing member for mounting a liquid supply source, the supply source fixing member having a flow path which supplies the liquid from the liquid supply source to the head body, the rigid substrate is fixed between the head body and the supply source fixing member, and the fixing member fixes the supply source fixing member to the carriage at a position which does not pass through the rigid substrate.

4. The liquid ejecting head according to claim 3, wherein a gap between the supply source fixing member and the carriage is narrower than the length of the fixing member in the Z direction.

5. A liquid ejecting apparatus comprising the liquid ejecting head according to claim 4.

6. The liquid ejecting head according to claim 3, wherein a gap between the outermost fixing members in the X direction is 0.8 to 1.1 with respect to the dimension of the rigid substrate.

7. A liquid ejecting apparatus comprising the liquid ejecting head according to claim 6.

8. The liquid ejecting head according to claim 3, wherein the connector is arranged only on one side in the X direction on the rigid substrate.

9. A liquid ejecting apparatus comprising the liquid ejecting head according to claim 8.

10. A liquid ejecting apparatus comprising the liquid ejecting head according to claim 3.

11. A liquid ejecting apparatus comprising the liquid ejecting head according to claim 2.

12. A liquid ejecting apparatus comprising the liquid ejecting head according to claim 1.

13. The liquid ejecting apparatus according to claim 12, further comprising:

a cap with respect to the head, the cap being arranged further to the other side in the X direction than a rib; and a fixed section which is fixed to the signal line more to the one side in the X direction than the cap, wherein the connector and a region where the discharge medium of a maximum printable size is transported overlap in the Z direction at a position where the head is capped.

14. The liquid ejecting apparatus according to claim 12, further comprising:

a cap with respect to the head; and wherein the connector where the head is in confrontation with the cap is configured to overlap the discharge medium in the Z direction.

15. A liquid ejecting apparatus comprising:

a head configured to discharge liquid from a nozzle on a nozzle surface based on data;

a signal line configured to send head data via a connector of the head;

a carriage on which the head is mounted; and a cap with respect to the head, wherein in a case where an X direction, a Y direction, and a Z direction are orthogonal to one another, the carriage is configured to move relative to a discharge medium in the X direction, and the nozzle surface is specified as the XY horizontal plane, the connector where the head is in confrontation with the cap is configured to overlap the discharge medium in the Z direction, and the signal line is connected to the connector with terminals lineally lined up in the Y direction, and the terminals are provided at a side surface of the head.

* * * * *